US006962555B2

(12) United States Patent
Behman

(10) Patent No.: US 6,962,555 B2
(45) Date of Patent: Nov. 8, 2005

(54) MUSCLE STRENGTHENING BODY FRAMES

(76) Inventor: Rafik Behman, 345 Webster Ave. #1-I, Brooklyn, NY (US) 11230

( * ) Notice: Subject to any disclaimer, the term of this patent is extended or adjusted under 35 U.S.C. 154(b) by 381 days.

(21) Appl. No.: 10/197,551

(22) Filed: Jul. 18, 2002

(65) Prior Publication Data

US 2003/0022769 A1 Jan. 30, 2003

Related U.S. Application Data

(60) Provisional application No. 60/307,519, filed on Jul. 24, 2001.

(51) Int. Cl.[7] ..... A63B 21/00

(52) U.S. Cl. ..... 482/124; 482/121; 482/127

(58) Field of Search ..... 482/127, 124, 482/121, 79, 80; 128/892; 2/16, 23, 24, 92

(56) References Cited

U.S. PATENT DOCUMENTS 5,129,647 A 7/1992 Castellanos
5,137,272 A * 8/1992 Wilkinson ..... 482/124
5,465,428 A 11/1995 Earl
5,570,472 A 11/1996 Dicker
5,683,336 A * 11/1997 Pape
5,708,976 A 1/1998 Dicker
5,980,436 A * 11/1999 Cheng ..... 482/124
6,053,852 A 4/2000 Wilkinson
6,709,369 B1 * 3/2004 Jacobs ..... 482/180

* cited by examiner

*Primary Examiner*—Jerome W. Donnelly
(74) *Attorney, Agent, or Firm*—Sonya C Harris; Randy Shay

(57) ABSTRACT

The present invention features a a muscle strengthening exerciser to be worn at specific parts of the body. This inventive muscle strengthening body frame apparatus can be worn on isolated body parts as non-apparel items for direct longitudinal resistive forces exerted on the body part of the wearer during movement. The apparatus comprises a frame assembly consisting of a first and second portions which are joined together by a resistance bar. The resistance bar provides the resistive forces providing muscular activity to adjacent body parts.

5 Claims, 2 Drawing Sheets

MUSCLE STRENGTHENING BODY FRAMES

RELATED APPLICATIONS

This application is related to the provisional application Ser. No. 60/307,519 filed Jul. 24, 2001 entitled "Muscle Strengthening Body Frames."

BACKGROUND OF THE INVENTION

1. Field of the Invention

The present invention relates to an exerciser apparatus and, more particularly, to a muscle strengthening resistance exerciser.

2. Discussion of the Prior Art

The prior art is replete with devices designed to be worn on the human body in order to create muscle tone, and enhance muscle strength by providing exercise for the wearer.

The U.S. patents to Dicker (U.S. Pat. Nos. 5,708,976 and 5,570,472) are for a Resistant Exercise Shirt and Pants. This invention is directed toward a resistive exercise suit that has a resistive shirt and resistive trousers. The shirt uses tension bands on sleeve fronts and backs and attachments to central elastic blocks on the front and back of the shirt. The resistive exercise trousers fit snugly upon the wearer with adjustable straps and stirrups. Vertical resistive panels running along the length of the trousers serve to resist the motion of the leg in any direction.

The U.S. patent to Earl (U.S. Pat. No. 5,465,428) is for an Exercise Device of Adjustable Resistance for Flexing of Muscles of the Legs and Torso. This device is designed particularly for the lower portion of the body and comprises a torso belt-like element which connects to leg straps worn on the legs. The connection is made via elasticized members which provide the resistance for the device.

Wilkinson discloses in U.S. patent (U.S. Pat. No. 6,053,852) an Energy Expenditure Garment. This garment contains elastic ring sections that provide resistance forces to the body of the wearer.

Castellanos discloses an Elastic Resistance Exerciser Secured at the Waist in U.S. Pat. No. 5,129,647. Again, herein lies a device designed specifically to be worn on a particular body part. Disclosed is a belt-like device with prescribed attachments for providing elastic resistance for exercising.

None of these patents either teaches or suggests the inventive muscle strengthening body frame that can be worn on isolated body parts as non-apparel items for direct longitudinal resistive forces exerted on the body part of the wearer during movement. As will be seen in greater detail hereinafter, the present invention involves a resistance bearing device which can be worn on various body parts that is intended to provide muscle strengthening when worn.

SUMMARY OF THE INVENTION

The present invention features a muscle strengthening exerciser to be worn at specific parts of the body. This inventive muscle strengthening body frame apparatus can be worn on isolated body parts as non-apparel items for direct longitudinal resistive forces exerted on the body part of the wearer during movement. The apparatus comprises a frame assembly consisting of first and second portions which are joined together by a resistance bar. The resistance bar provides the resistive forces providing muscular activity to adjacent body parts.

It is therefore an object of the invention to provide a muscle strengthening exerciser to be worn at specific parts of the body which is designed to create direct resistance at that portion of the body.

It is another object of the invention to provide a muscle strengthening exerciser to be worn at specific parts of the body that is light-weight and easy to use.

It is also an object of the invention to provide a muscle strengthening exerciser to be worn at specific parts of the body that can be applied to various body parts.

It is a further object of the invention to provide muscle strengthening exerciser to be worn at specific parts of the body that creates muscle exercising and toning resistance without employing the use of heavy, burdensome weights.

It is an additional object of the invention to provide a muscle strengthening exerciser to be worn at specific parts of the body that enables a wearer with insufficient time to pursue an exercise regimen, the opportunity to obtain a desirable amount of exercise.

It is a still further object of the invention to provide a muscle strengthening exerciser to be worn at specific parts of the body that is usable in a number of different fitness settings, to enable a more effective exercise of certain portions of the body while the wearer is walking, running, swimming, playing sports, utilizing exercise machines or the like.

It is another object of the invention to provide a muscle strengthening exerciser to be worn at specific parts of the body that is of compact construction and is economical.

These and other objects, features and advantages will be more apparent form a study of the enclosed text and the appended drawings.

BRIEF DESCRIPTION OF THE DRAWINGS

A complete understanding of the present invention may be obtained by reference to the accompanying drawings, when taken in conjunction with the detail description thereof and in which.

DESCRIPTION OF THE PREFERRED EMBODIMENT

This disclosure of the invention is submitted in furtherance of the constitutional purposes of the U.S. Patent Laws "to promote the progress of science and useful arts" (Article 1, Section 8).

Generally speaking this invention relates to a muscle strengthening exerciser to be worn at specific parts of the body to enhance muscle tone and strength by targeting specific muscles in a particular area of the body. In accordance with the present invention, a muscle strengthening body frame (MSBF) 100, is shown generally at FIGS. 1 and 2. The MSBF 100 is designed with the shape and corresponding elements such that the frames 10 are snugly fit onto the desired body parts for use on various areas of the human body. Once placed on the body part, the MSBF's are designed to apply direct resistance on a body area by creating direct resistance, along a suitable distance, a fixed force between two movable body parts.

Figure 1:
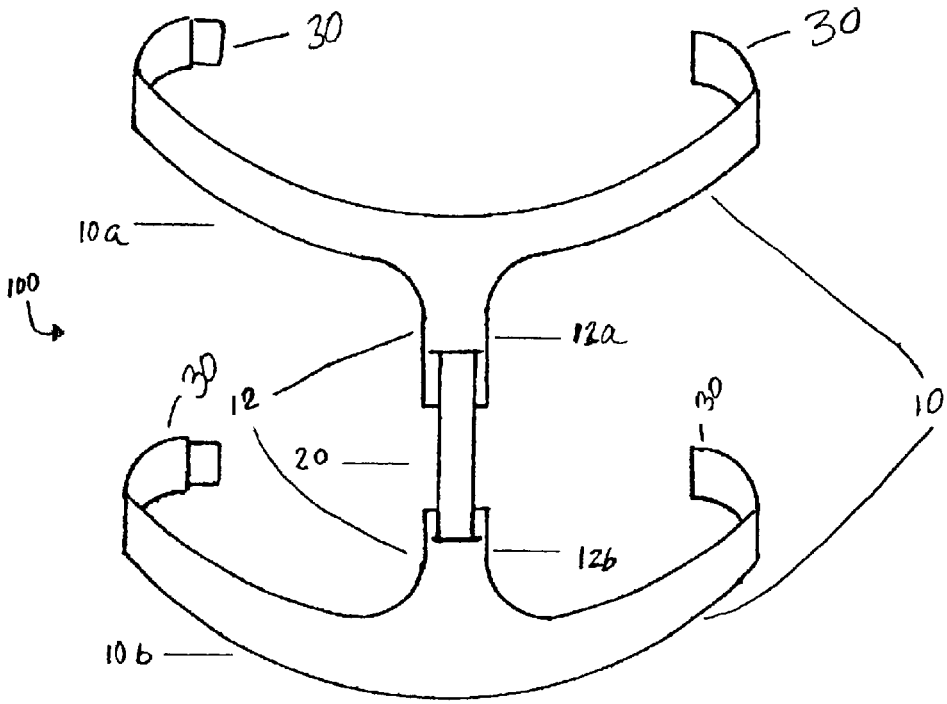
FIG. 1 is a front perspective view of the preferred embodiment of the inventive muscle strengthening body frame.
Figure 2:
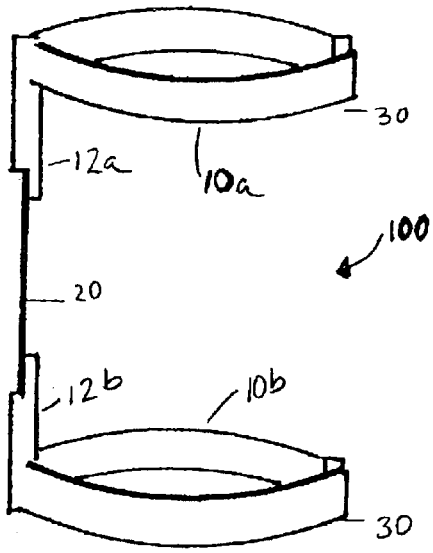
FIG. 2 is a side perspective view of the muscle strengthening frame, in accordance with the present invention.

As shown in FIG. 1, the MSBF 100 has three major parts. These parts comprise a frame assembly having at least two attachment means, being the upper attachment band 10*a* and the lower attachment band 10*b*. These two attachment bands 10*a* and 10*b* are connected to one another by at least one a resistance bar 20.

Each of the attachment bands 10 have means at the distal ends for securing the MSBF 100 to the body. The securing can be done via any suitable fastening means known in the art such as, but not limited to, hook-and-loop fasteners (e.g. VELCRO™), buckles, buttons, and snaps. The securing means is shown illustratively at 30.

The attachment bands 10 each have at least one connection unit formed by an extension portion 12 which houses the resistance bar 20. The upper extension portion 12*a* and the lower extension portion 12*b* extend toward each other along a longitudinal axis with the resistance bar 20 attached to each, as shown in the side perspective view of FIG. 2. The attachment bands 10 may be made of a layered material to allow housing of the resistance bar 20. The extension portions 12 preferably has means to allow one or both ends of the resistance bar 20 to move for a small displacement inside the extension portions 12 to permit the resistance bar 20 length to be longer in the extended position than in the relaxed position.

The material of the attachment bands 10 may also be comprised of a material which retains its general shape for enhanced fitting on body parts. These materials are known as shape-retaining memory materials and may comprise metals, metal alloys, natural fabrics, synthetic fabrics and any combinations thereof.

Figure 3:
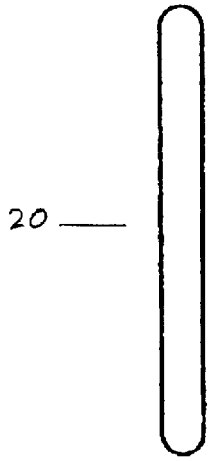
FIG. 3 is a front view of the resistance bar, in accordance with the present invention.

The resistance bar 20, as shown in FIG. 3, may be made of any suitable material which provides elastic, reciprocal movement between the upper and lower attachment bands 10 and which bend against its own resistance. The resistance bar 20 may be comprised of natural and synthetic fibers, metallic materials, elastomers and any combinations thereof which may provide tension forces on the body area during longitudinal movement. The resistance bar 20 may also comprise appropriately configured spring structures or may be a mechanism or design that bends against its own resistance.

The MSBF 100 may be used on various parts of the human body. FIGS. 4–9 illustrate the muscle strengthening body frame 100 being used on several positions on the body. For appropriate fitting on these various parts, the MSBF 100 may be manufactured in different sizes.

Figure 4:
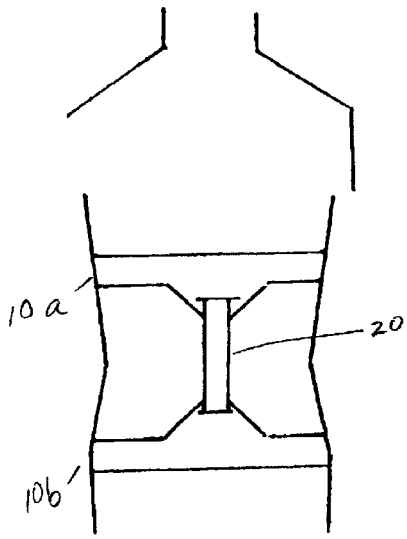
FIG. 4 is an environmental view of the muscle strengthening body frame in use on the torso area of a user.
Figure 5:
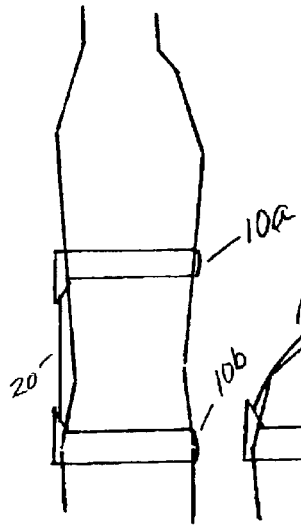
FIG. 5 is a side view of the muscle strengthening body frame in use on the torso area of a user.
Figure 6:
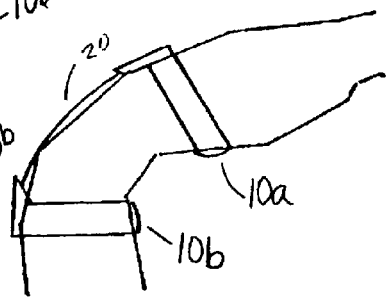
FIG. 6 illustrates a side view of the muscle strengthening body frame of FIGS. 4 and 5, in use as resistance is applied on the torso area.
Figure 7:
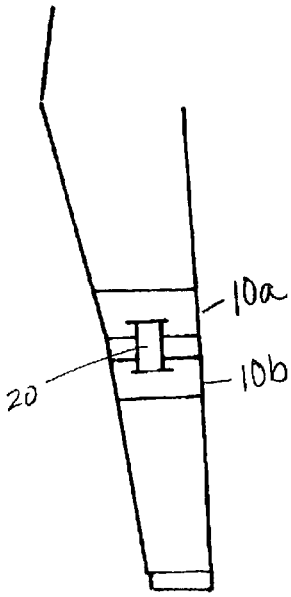
FIG. 7 is a front view of the inventive device as worn of the knee of a user.
Figure 8:
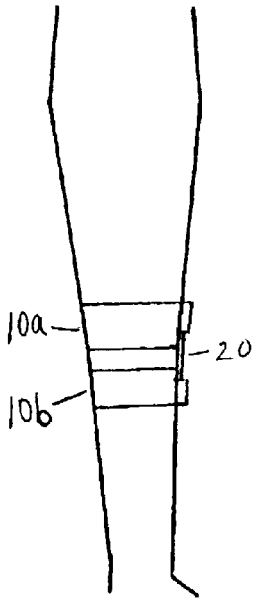
FIG. 8 is a side view of the inventive device as worn of the knee of a user.

For example, as seen in FIGS. 4–6, the MSBF 100 is shown in use on the torso area. Herein, the MSBF 100 may be of a large size for appropriate fitting on the upper body, specifically targeting the abdominal (FIG. 4) or back (FIGS. 5 & 6) area. Likewise, for appropriate fitting for use on the leg/knee area (FIGS. 7–9), the MSBF 100 may be of a medium size. The sizes are exemplary relative terms to reference relative sizes of the device as used on the human body.

Figure 9:
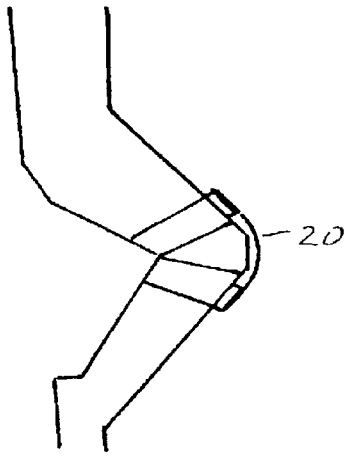
FIG. 9 is a side view of the inventive device in use in the area of the knee of a wearer.

FIGS. 6 and 9 show the operation of the MSBF 100 as it may be used on various body parts. With movement of the body area, the resistance bar 20 provides tension forces along a longitudinal axis relative to the body part. Herein, these forces provide the means for strengthening the body part during movement.

Since other modifications and changes varied to fit a particular operating requirements and environment will be apparent to those skilled in the art, the invention is not considered limited to the example chosen for purposes of disclosure, and covers all changes and modifications which do not constitute a departure from the true spirit and scope of the invention.

Having thus described the invention, what is desired to be protected by Letters Patent is presented in the subsequent appended claims.

What is claimed is:

1. A muscle strengthening body frame apparatus for providing direct resistance on a body portion of a wearer, said body portion having an upper and a lower section capable of moving along a longitudinal axis said muscle strengthening body frame apparatus for providing direct resistance on the longitudinal axis of each of the following body portions of a wearer between each portion's upper and lower sections:

back and torso axis, knee axis between the thigh and the shin, elbow axis between the upper arm and the forearm, wrist axis between the forearm and the hand and back of the neck axis between top of the head and the under shoulders, said apparatus comprising:

a first attachment band comprising means for at least encircling a first location on the upper section of the body portion, and a second attachment band comprising means for at least encircling a second location on the lower section of the same body portion, and at least one resistance bar operatively connected to said first and second attachment bands said first and second attachment bands each extending long a horizontal axis, parallel to each other, said resistance bar extending laterally there between defining a longitudinal axis, preferably perpendicular to said each of the attachment bands;

wherein, when in use, said first and second attachment bands respectively encircle a first and a second locations on the upper and lower sections of the body portion with the resistance bar in-between, lies substantially along the longitudinal axis of said body portion, and movement of the body portion results in longitudinal resistance forces being exerted by the body frame apparatus on the body portion.

2. The muscle strengthening body frame as in claim 1 wherein, said first and second attachment bands are made of shape-retaining memory materials of predetermined dimensions for recurrent fittings on particular body portion.

3. The muscle strengthening body frame apparatus of claim 1, wherein said shape-retaining memory material is comprised of materials from the group consisting of metals, metal alloys? natural fabrics, synthetic fabrics and combinations thereof.

4. The muscle strengthening body frame apparatus of claim 3 wherein said first and second attachment bands each further comprise fastening means for securement onto the body portion part of the wearer.

5. the muscle strengthening body frame apparatus of claim 4 wherein, said fastening means is selected from the group consisting of;

hook-and-loop fasteners, buckles, buttons, and snaps.

* * * * *